US005223020A

United States Patent [19]

Kolaska

[11] Patent Number: 5,223,020

[45] Date of Patent: Jun. 29, 1993

[54] HARD-METAL BODY

[75] Inventor: Hans Kolaska, Bottrop, Fed. Rep. of Germany

[73] Assignee: Krupp Widia GmbH, Essen, Fed. Rep. of Germany

[21] Appl. No.: 684,901

[22] PCT Filed: Oct. 18, 1989

[86] PCT No.: PCT/DE89/00662

§ 371 Date: Apr. 24, 1991

§ 102(e) Date: Apr. 24, 1991

[87] PCT Pub. No.: WO90/05200

PCT Pub. Date: May 17, 1990

[30] Foreign Application Priority Data

Oct. 31, 1988 [DE] Fed. Rep. of Germany ..... 3837006

[51] Int. Cl.[5] ..... C22C 29/04

[52] U.S. Cl. ..... 75/238; 75/236; 75/240; 75/242; 75/244; 75/248; 419/38; 419/39

[58] Field of Search ..... 75/236, 238, 240, 242, 75/244, 248; 419/38, 39

[56] References Cited

U.S. PATENT DOCUMENTS

| | | | |
|---|---|---|---|
| 3,215,510 | 11/1965 | Kelly et al. | 75/240 |
| 4,330,333 | 5/1982 | Gibbs | 75/244 |
| 4,374,685 | 2/1983 | Suzuki et al. | 148/126.1 |
| 4,628,178 | 12/1986 | Miyake et al. | 219/118 |
| 4,636,252 | 1/1987 | Yoshimura et al. | 75/238 |
| 4,649,084 | 3/1987 | Hale et al. | 428/552 |
| 4,684,405 | 8/1987 | Kolaska et al. | 75/240 |

FOREIGN PATENT DOCUMENTS

| | | |
|---|---|---|
| 0195965 | 10/1986 | European Pat. Off. . |
| KW2888 | 7/1990 | European Pat. Off. . |
| 764144 | 7/1952 | Fed. Rep. of Germany . |
| 3519114A1 | 12/1985 | Fed. Rep. of Germany . |
| 3511220A1 | 10/1986 | Fed. Rep. of Germany . |

OTHER PUBLICATIONS

Patent Abstract of Japan, vol. 6, No. 15 (C-089) 28 Jan. 1982.

Patent Abstract of Japan, vol. 9, No. 297 (M-432) 25 Nov. 85.

*Primary Examiner*—Donald P. Walsh
*Assistant Examiner*—Ngoclan T. Mai
*Attorney, Agent, or Firm*—Herbert Dubno

[57] ABSTRACT

The invention relates to a hard-metal body whose hard-metal phase consist of tungsten carbide and whose binder metal phase consists of nickel and chrome.

Especially for the enhancement of the corrosion resistance it is proposed that the hard metal contain also TiN in addition to the hard-metal phase, whereby the content of TiN and and binder metal phase amounts to 5 to 25% by mass and is composed by 0.1 to 10% by mass TiN, 5 to 15% by mass chrome, the balance being made up by nickel.

3 Claims, 2 Drawing Sheets

SPECIFIC MASS LOSS (g/m)
0
1
2
3
4
5
6
7
90.5% WC
8.5% Ni
1.0% Cr
90.2% WC
8.5% Ni
1.0% Cr
0.3% Mo
90.2% WC
8.5% Ni
1.0% Cr
0.3% TiN

HARD-METAL BODY

The invention relates to a hard-metal body according to the introductory part of claim 1.

Such hard metals are already known, e.g. the European patent specification EP 0 195 965 A3 discloses a hard metal, which besides the hard-metal phase contains binder metal phase between 5 to 25% by weight, which is composed by 5 to 15% by weight chrome and the balance nickel, and whereby after sintering, the hard metal is treated for a period of 20 to 200 minutes in an atmosphere of inert gas, preferably an argon atmosphere, at a temperature of 1300° to 1400° C. and a pressure of 20 to 3000 bar.

The U.S. Pat. No. 3,215,510 discloses a hard-metal body consisting of 10 to 30% by mass of a chrome-nickel binder alloy, the balance made up by tungsten carbide, whereby the weight ratio of chrome to the binder metal ranges between 0.015 and 0.15. This hard-metal body is produced by pressing and sintering from powdery raw materials.

Finally the JP-A-56 136 952 presents a sintered hard-metal body on the basis of WC-Ni, which contains 3 to 30% Ni and 0.05 to 4.5% Cr, as well as 0.5 to 20% of at least one nitride of Ti, Zr, V, Nb. Further, in the German article by Kieffer and Benesowsky, in HARTMETALLE, 1965, pages 220, 221 and 228, a hard metal is described consisting of 90% by mass tungsten carbide, 8% by mass nickel and 2% by mass chrome. However, these in themselves corrosion-resistant hard metals have disadvantageously a very low strength and especially a very low ductility, so that their practical applications are limited.

From EP 0 028 620 B1 a further sintered hard alloy is known, which for the purpose of achieving good strength, ductility, as well as corrosion and oxidation resistance, consists of 55 by 95% by volume of hard materials with a minimum of 90% tungsten carbide and optionally further carbides, as well as 5 to 45% by volume single-phase binders with a minimum of 50% nickel, 2 to 25% chrome, 1 to 15% molybdenum and as a maximum for each 10% manganese, 5% aluminum, 5% silicon, 10% copper, 30% cobalt, 20% iron and 13% tungsten.

Finally, in EP 0 214 679 A1 a corrosion-resistant hard-metal alloy is proposed consisting of 31 to 84% by weight tungsten carbide, 15 to 60% by weight of one or several carbides of the group tantalum carbide, niobium carbide, zirconium carbide, titanium carbide, chrome carbide, molybdenum carbide,as well as 1 to 9% by weight of a binder alloy of nickel and/or cobalt with a 2 to 40% by weight chrome addition. This alloy is also supposed to have good mechanical strength characteristics and a high resistance to wear.

Experience has proven that the heretofore-known alloys are not satisfactory from the point of view of corrosion resistance.

It is therefore the object of the present invention to propose a hard-metal body having high mechanical strength as well as wear resistance, and in addition thereto, an improved resistance to corrosion.

This object is attained due to the hard-metal body defined in claim 1, consisting of tungsten carbide, 0.005 to 0.3% by mass TiN, chrome and nickel, whereby the proportion of TiN and binder metal phase together amounts to 5 to 25% by mass, and this proportion contains 5 to 15% by mass chrome and which is produced from powdery raw materials through pressing and sintering. The advantages of this alloy are an improved corrosion resistance, particularly in the medium sulfuric acid, and the simultaneous considerable reduction of abrasion wear. The good mechanical characteristics make possible a safe use of the alloy in chemical plants, as well materials exposed to extreme combustion temperatures.

According to a further embodiment of the invention, after sintering the hard-metal body is treated during 20 to 200 minutes in an atmosphere of inert gas, particularly argon atmosphere, at a temperature of 1300° to 1400° C. and at a pressure of 20 to 3000 bar. As a result of this treatment, the hard metal achieves a good strength and an excellent ductility, which can be explained by a high degree of densification of the hard-metal structure. Especially, it is possible to cool down the sintered hard-metal body and then to treat it in a separate installation at 100 to 3000 bar or immediately after sintering in the sintering plant at 20 to 100 bar. This shows that the immediate treatment after sintering allows operation at low pressures.

Preferably, in the hard-metal body according to the invention 1 to 30% by mass of the tungsten carbide is replaced by titanium carbide, tantalum carbide and/or niobium carbide.

In a special embodiment example, three alloys, which have been subjected to the same treatment steps are compared to each other. In all cases, the start was a powdery mix of raw materials with a particle size of 0.5 to 5 μm. The pressing and sintering of the hard metal was performed according to the state of the art in the known manner at approximately 1400° C. The composition in % by mass results from the following table:

Material 1: 90.5% by mass WC, 8.5% Ni, 1% Cr

Material 2: 90.2% by mass WC, 8.5% Ni, 1% Cr, 0.3% Mo

Material 3: 90.2% by mass WC, 8.5% Ni, 1% Cr, 0.3% TiN

Figure 1:
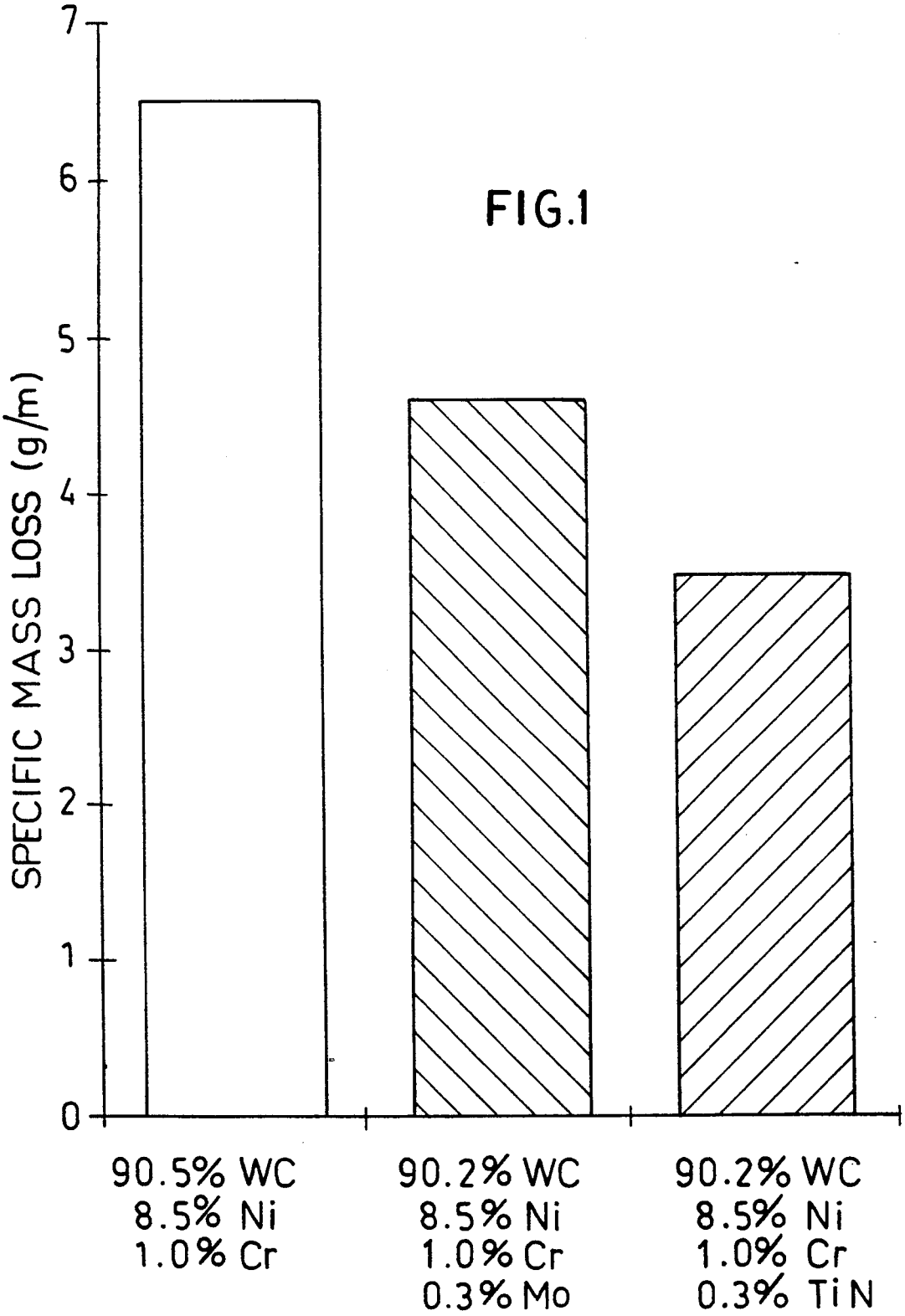
FIGS. 1 and 2 are graphs illustrating the examples.

The finished sintered metals subsequently subjected to an inert-gas atmosphere under pressure showed the specific mass loss illustrated in FIG. 1: the abrasion wear of the hard-metal body of the invention was thereby clearly lower than the one of the two other materials 1 and 2 known to the state of the art.

Figure 2:
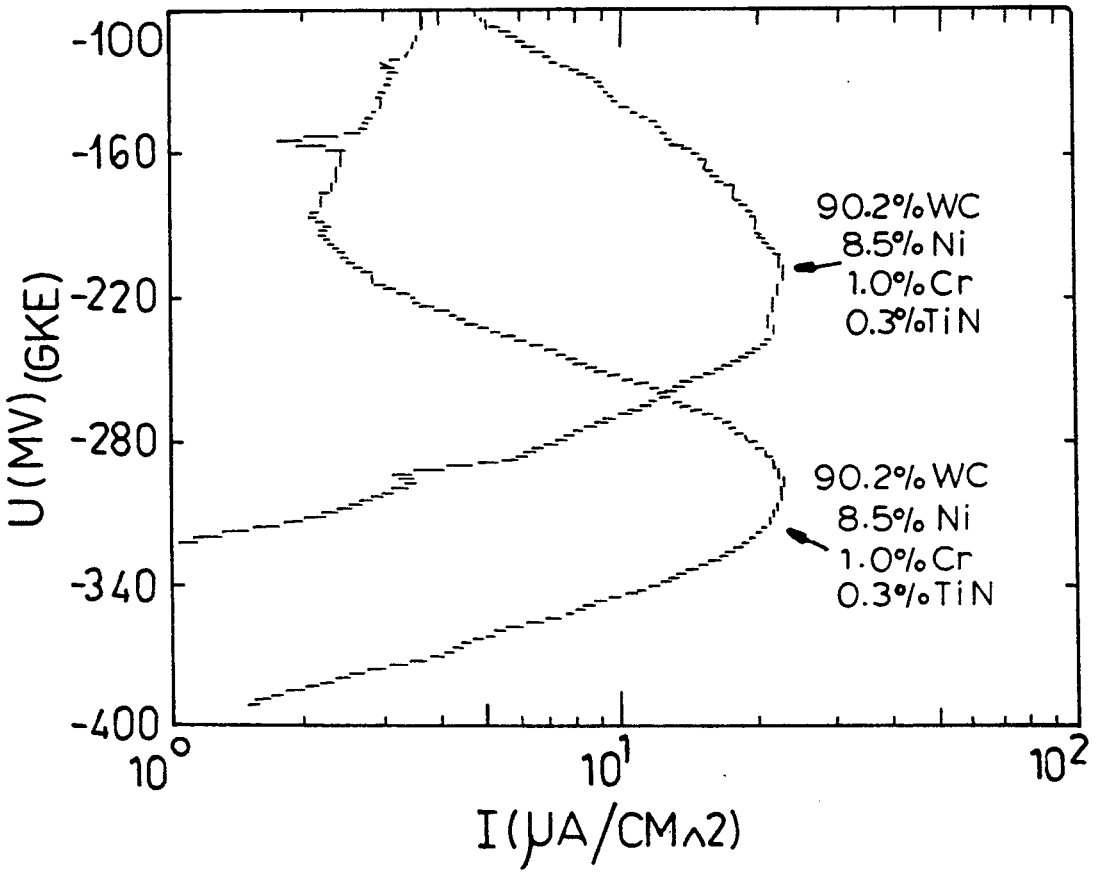

The solutions had the following compositions: $H_2O$ with 300 mg $Cl^{-b}/l$ and 200 mg $SO_4^{--}/l$ as sodium salts with acetic acid set to a pH=4. The thereby measured current-density/potential curves are shown in FIG. 2. In the established test conditions, the hard metal with the TiN-addition according to the invention shows a current surge only at more positive potentials, proving this way a lower sensitivity to corrosion.

I claim:

1. Sintered hard-metal body, consisting of tungsten carbide, 0.005 to 0.3% by mass TiN, and metal binder of phase of chrome, and nickel, whereby the content of TiN and metal binder phase together amounts to 5 to 25% by mass, this content comprising 15% by mass chrome, and which has been produced from powdery raw materials through pressing and sintering.

2. Hard-metal body according to claim 1, wherein after sintering the hard metal is treated during a time period of 20 to 200 minutes in an atmosphere of inert gas, preferably argon, at a temperature of 1300° to 1400° C. and a pressure of 20 to 3000 bar.

3. Hard metal according to claim 1 wherein 1 to 30% by mass of the tungsten carbide is replaced by titanium carbide, tantalum carbide and/or niobium carbide.

* * * * *